US005878470A

United States Patent [19]

Blansett

[11] Patent Number: 5,878,470

[45] Date of Patent: Mar. 9, 1999

[54] METHOD FOR FORMING A FRAME FOR AN ARTICLE OF FURNITURE

[75] Inventor: Rubin Lee Blansett, London, Ky.

[73] Assignee: Insteel, Inc., Hazard, Ky.

[21] Appl. No.: 941,890

[22] Filed: Sep. 30, 1997

Related U.S. Application Data

[60] Continuation of Ser. No. 655,755, May 30, 1996, abandoned, which is a division of Ser. No. 255,699, Jun. 7, 1994, Pat. No. 5,529,380.

[51] Int. Cl.[6] ..... B68G 7/00

[52] U.S. Cl. ..... 29/91.1; 29/525.01; 29/897.312; 72/335; 72/379.2; 160/381

[58] Field of Search ..... 29/897.3, 897.312, 29/557, 91, 91.1, 91.5, 91.7, 525.01; 72/335, 379.2, 379.6; 297/452.18, 440.12, 440.23, DIG. 6; 52/658; 428/603; 160/381

[56] References Cited

U.S. PATENT DOCUMENTS

| | | | |
|---|---|---|---|
| 343,467 | 6/1886 | MacPhail . | |
| 1,357,319 | 11/1920 | Hadaway . | |
| 1,925,804 | 9/1933 | Hiering | 72/379.2 |
| 2,006,925 | 7/1935 | Klemp | 72/379.2 |
| 2,086,225 | 7/1937 | Hiering | 72/379.2 |
| 2,097,927 | 11/1937 | Klemp | 72/379.2 |
| 2,123,842 | 7/1938 | Cox | 72/379.2 |
| 2,207,381 | 7/1940 | Lang | 72/379.2 |
| 2,241,266 | 5/1941 | Mayne et al. . | |
| 2,458,095 | 1/1949 | O'Connor . | |
| 2,597,860 | 5/1952 | Gerber et al. . | |
| 2,641,311 | 6/1953 | Ingram, Jr. et al. . | |
| 2,705,995 | 4/1955 | McMurty . | |
| 2,913,041 | 11/1959 | Mathison . | |
| 2,952,342 | 9/1960 | Schnittser . | |
| 3,101,218 | 8/1963 | Baermann . | |
| 3,121,588 | 2/1964 | Beckman et al. . | |
| 3,421,279 | 1/1969 | Franc . | |
| 3,726,561 | 4/1973 | Bolyos . | |
| 3,896,531 | 7/1975 | Gorman . | |
| 3,983,614 | 10/1976 | Koepke et al. . | |
| 4,209,198 | 6/1980 | Apple, Sr. . | |
| 4,269,255 | 5/1981 | Nailor et al. . | |
| 4,365,840 | 12/1982 | Kehl et al. . | |
| 4,523,787 | 6/1985 | Robinson . | |
| 4,623,114 | 11/1986 | Nishino . | |
| 4,711,495 | 12/1987 | Magder . | |
| 4,848,843 | 7/1989 | Gibbs . | |
| 4,962,622 | 10/1990 | Albrecht et al. . | |
| 5,018,263 | 5/1991 | Stern | 29/897.312 |
| 5,080,438 | 1/1992 | Moyer . | |
| 5,203,069 | 4/1993 | Hennig | 29/557 |
| 5,255,481 | 10/1993 | Misera et al. . | |
| 5,463,965 | 11/1995 | Cordrey . | |
| 5,628,114 | 5/1997 | Stern | 29/897.312 |

FOREIGN PATENT DOCUMENTS

| | | |
|---|---|---|
| 722 006 | 11/1965 | Canada . |
| 0 595 310 | 5/1994 | European Pat. Off. . |
| 1036268 | 9/1953 | France . |
| 1155860 | 5/1958 | France . |
| 2705332 | 11/1994 | France . |
| 3239292 | 5/1983 | Germany . |
| 6304350 | 11/1994 | Japan . |
| 6304351 | 11/1994 | Japan . |
| 679 044 | 9/1952 | United Kingdom . |

OTHER PUBLICATIONS

Int'l Search Report, Jun. 20, 1995, PCT/US95/03167, filed Mar. 14, 1995.

*Primary Examiner*—David P. Bryant
*Attorney, Agent, or Firm*—Alston & Bird, L.L.P.

[57] ABSTRACT

An apparatus and method for forming a metal frame for an article of furniture which includes a base portion made up of four peripheral edge members disposed in a rectangular arrangement. The frame also includes a back frame portion and two arm frame portions each having at least three peripheral edge members which are interconnected to each other at right angles. Each of the base frame portion, the back frame portion and the two arm frame portions includes at least one strip of longitudinally corrugated metallic sheet material which has at least one generally U-shaped longitudinally extending rib therein. Bend locations are provided for bending the strip of longitudinally corrugated metallic sheet material at right angles. A combination of corresponding strips of velcro, hooks and loops are used in conjunction with J-strips to removably attach upholstery to the frame.

7 Claims, 12 Drawing Sheets

61
MM
63
65
MM
67
69

X
X55
88
68
X45

Y
Y55
86
70
68

Z
68
Z55

X
62a
62
62b
64a
64b
64b
64a
64
62
Y
70
66
64
66
70
62

Z
70
66
62

METHOD FOR FORMING A FRAME FOR AN ARTICLE OF FURNITURE

This application is a continuation of application Ser. No. 08/655,755, filed May 30, 1996, now abandoned, which is a divisional of application Ser. No. 08/255,699 filed Jun. 7, 1994, now U.S. Pat. No. 5,529,380.

FIELD OF THE INVENTION

The present invention relates to the field of furniture, and, more particularly to, an apparatus and method for forming a metal frame for an article of furniture.

BACKGROUND OF THE INVENTION

The use of wood in the construction of furniture for chairs, sofas and the like is well-known. Alternative materials such as metal or plastic have met with some success but, such success has been limited to specific areas. For example, U.S. Pat. No. 2,458,095 to O'Connor illustrates an example of the successful use of metal in seat construction for folding chairs. Metal has also successfully been used in seat frames for vehicle seats as disclosed in U.S. Pat. No. 4,623,114 to Sishino and U.S. Pat. No. 4,365,840 to Kehl et al.

However, metal frames have not been well received within the furniture industry for use in upholstered chairs, sofas or the like. Although metal frames are recognized as being sturdy, in the past, they have been much too heavy to be marketable or economically transported.

The inability of plastic to support the weight tolerances associated with conventional upholstered furniture and the shortcomings associated with past metal frames has resulted in the continued use of wood as the preferred material in frames for upholstered furniture. This is especially true of upholstered furniture which is to be used in residential homes and in industrial settings such as hospitals and office buildings.

Conventional wooden frames however tend to weaken and breakdown over a period of time. In addition, as wood becomes less available it correspondingly becomes more costly to produce wooden frames. Furthermore, wood only lends itself to permanent upholstery methods such as staples and does not allow the consumer to replace fabric without considerable effort, knowledge and tooling.

Low cost modular furniture which is lightweight yet sturdy, easy to produce, and which may be constructed in sub-assemblies which are easy to ship is desired by both consumer and retailer alike. In addition, consumers desire furniture which would allow them to replace the fabric or upholstery which was initially purchased as the upholstery is worn and/or goes out of style, without great cost or inconvenience.

U.S. Pat. No. 4,523,787 to Robinson generally discloses the ability to replace the upholstered panels of a sofa. Each of the replaceable back and side panels of the Robinson invention defines a hollow structure which slides over the respective back and arm of the frame. A front panel is removably attached to the metal frame by bolts. In this configuration, upholstered panels are used which are fit over the furniture frame rather than providing a metal frame which, when upholstered, cannot be distinguished from furniture made from a traditional wooden frame.

Therefore, the ability to manufacture a metal frame for upholstered furniture which has the same quality and appearance as a traditional wooden frame is desirable. In addition, it is desirable to produce a metal frame constructed of several easy to assemble sub-assemblies which is sturdy yet lightweight, while allowing quick and easy reupholstery.

SUMMARY OF THE INVENTION

In view of the foregoing background, it is therefore an object of the present invention to provide an improved frame for furniture which is both lightweight yet sturdy and which allows the consumer to quickly and easily reupholster as desired.

These and other objects, features and advantages of the present invention are obtained by providing a frame, preferably made of metal for use in an article of upholstered furniture. The metal frame includes a base frame portion which is made up of four peripheral edge members which are disposed in a rectangular arrangement so as to define opposite side edges and opposite ends. The frame also includes a back frame portion and two arm frame portions, each having at least three peripheral edge members which are interconnected to each other at right angles. Each of the peripheral edge members of the base frame portion, the back frame portion and the two arm frame portions includes at least one strip of longitudinally corrugated metallic sheet material. The base frame portion, the back frame portion, and the two arm frame portions are interconnected so that the back frame portion extends upwardly from the base frame portion along one of the side edges thereof, and the two arm frame portions extend upwardly from respective opposite ends of the base frame portion. The frame also includes a seating portion attached thereto.

It is preferable that at least one strip of the longitudinally corrugated sheet material be made of a single unitary strip which is folded to form a plurality of right angled corners. These folds may be obtained by forming a V-shaped notch in each side of the strip so as to define a transverse line therebetween and forming at least one opening along this transverse line. Longitudinal corrugations may also be formed along the length of the strip so as to define at least one U-shaped rib which is interrupted by at least one opening. One of the strips may also include respective side edge wall segments. Each of the U-shaped ribs should be substantially equal in height and width to provide a lightweight yet sturdy frame.

Rather than use the same strip of longitudinally corrugated strip of sheet material to form all of the elements of the frame, it is preferable to have one strip of the longitudinally corrugated sheet material comprise a first component which forms the base frame portion and have another strip of the longitudinally corrugated sheet material comprising a second component which is used to form the back frame portion and the two arm frame portions. The configuration of the first component and the second component is such that the first component includes five longitudinal ribs while the second component includes three longitudinal ribs. To minimize the costs associated with production of the strips of longitudinally corrugated sheet material, it is also advantageous to have the shapes of the first component and the second component be similar so that the second component corresponds to a center portion of the first component. The first component may also include a pair of inwardly facing opposed side flanges. These flanges provide additional strength to the first component and provide an additional location to affix the upholstery.

A plurality of third components are provided to span sections of the back frame portion, increasing the strength and stability thereof. Each of the third components has a single rib and is configured so as to corresponds to a center portion of the second component, thereby decreasing the time and costs associated with manufacturing the components.

The base frame portion, the back frame portion, and the two arm frame portions are constructed so that all visible portions of the frame are covered by the upholstery fabric material. Preferably a combination of J-strips and corresponding strips of Velcro® hook portions and loop portions are used to removingly secure the upholstery fabric to the frame.

BRIEF DESCRIPTION OF THE DRAWINGS

Some of the objects, features and advantages of the present invention having been stated, others will appear as the description proceeds, when taken in conjunction with the accompanying drawings in which.

DESCRIPTION OF THE PREFERRED EMBODIMENT

The present invention will now be described more fully hereinafter with reference to the accompanying drawings, in which the preferred embodiment of the invention is shown. This invention may, however, be embodied in different forms and should not be construed as limited to the embodiment set forth herein. Rather, the illustrative embodiment is provided so that this disclosure will be thorough and complete, and will fully convey the scope of the invention to those skilled in the art. Like numbers refer to like elements throughout.

Figure 1:
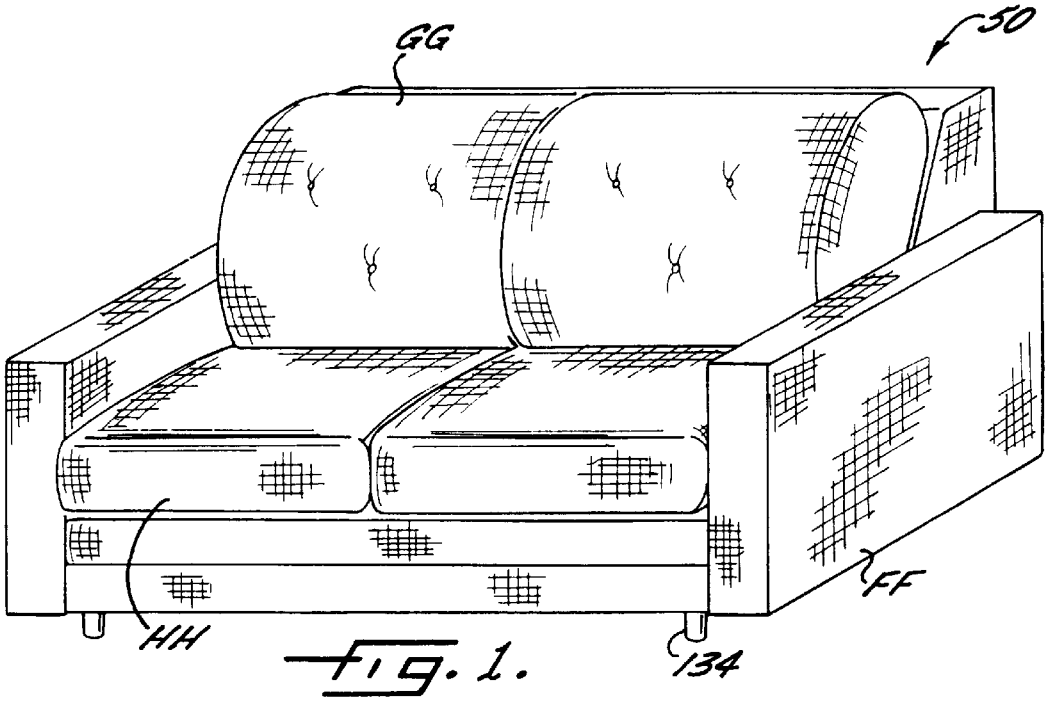
FIG. 1 is a perspective view of an article of furniture in accordance with the present invention.
Figure 2:
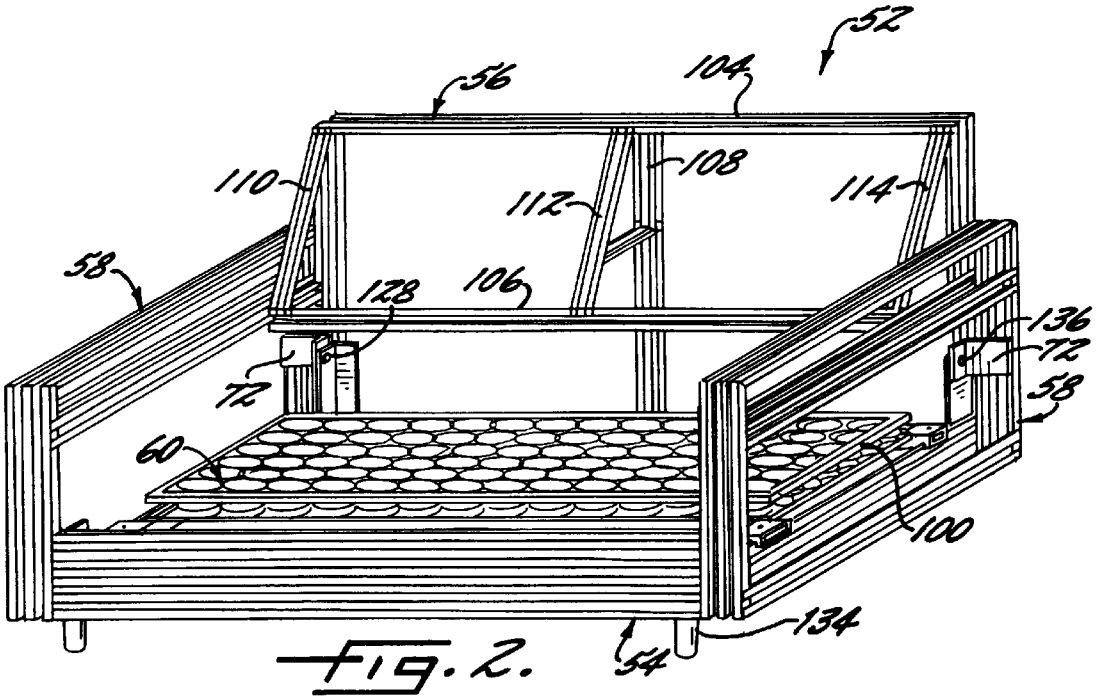
FIG. 2 is a perspective view of a frame for an article of furniture.
Figure 6:
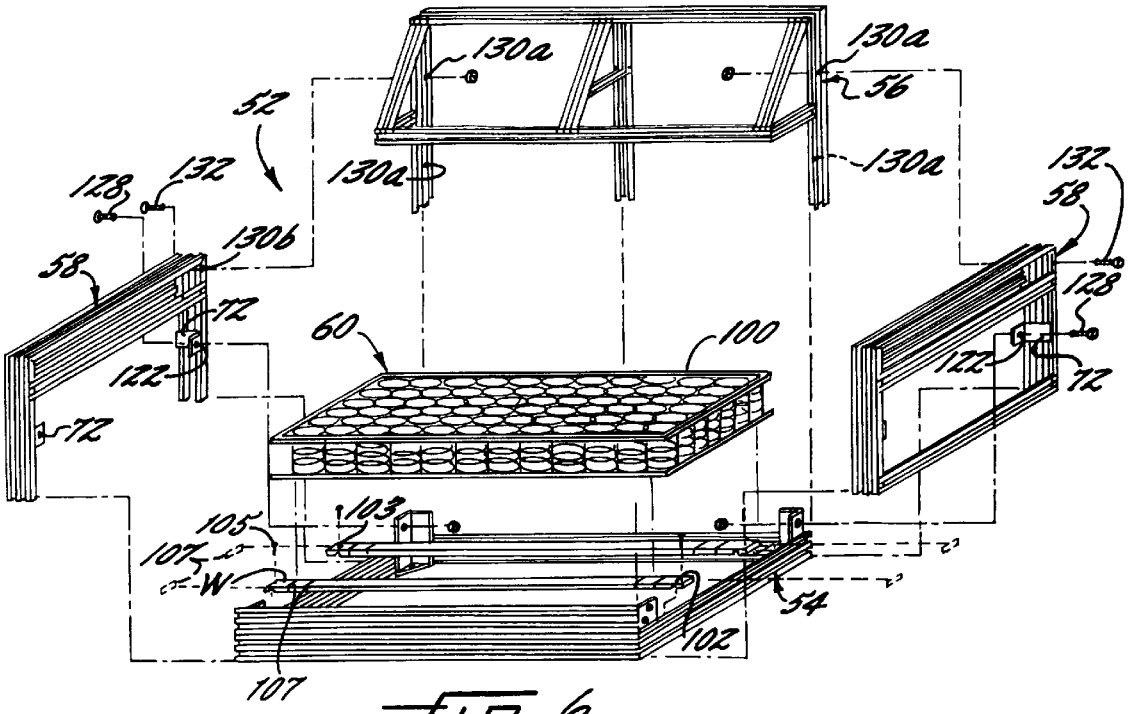
FIG. 6 is an exploded view of the frame illustrated in FIG. 2 showing the various subassemblies thereof.

Referring to the drawings, it may be seen that a love seat, shown in FIG. 1 and generally indicated at 50, will be used as an example to explain the features and advantages of the present invention. It is to be understood however, that other pieces of upholstered furniture such as a chair, a couch or a sofa bed may also be manufactured according to the invention herein described. As shown in FIGS. 2 and 6, the love seat 50 includes a frame 52, which is preferably made of metal. The frame 52 is formed from a number of subassemblies including a base frame portion 54, a back frame portion 56, and two arm frame portions 58. The base frame portion 54 further includes a seating portion 60.

As best understood by reference to FIGS. 3, 4A–4C, and 5A–5C, each of the base frame portion 54, the back frame portion 56 and the two arm portions 58 are constructed from three components, X, Y and Z, illustrated in FIGS. 4A and 5A, 4B and 5B, and 4C and 5C, respectively. Each of the three components X, Y and Z is formed from flat stock which is hot or cold rolled metal. To obtain the blanks shown in FIGS. 4A–4C, each elongated strip of metallic sheet material passes through the production line schematically represented in FIG. 3.

The process begins with a powered decoiler 61 rolling metal MM off of a coil. The metal MM is pulled through a straightener 63, which ensures that the metal is flat before it enters notching and cut-off presses 65. The presses 65 are computer controlled to locate and cut a pair of side notches 62 in components X and Y (see FIGS. 4A and 4B). In addition, the presses 65 also locate and cut bend cut-outs 64 in components X and Y, and end cut-outs 66 in components Y and Z (see FIGS. 4A–4C). Upon exiting the presses 65, the metal strip MM enters a conveyer 67 designed to support and guide the strip of metal MM into a roll former 69. The roll former 69 bends each strip of metal MM into at least one longitudinal U-shaped rib 68 (see FIGS. 5A–5C).

Figures 3, 4A, 4B, 4C, 5A, 5B, 5C:
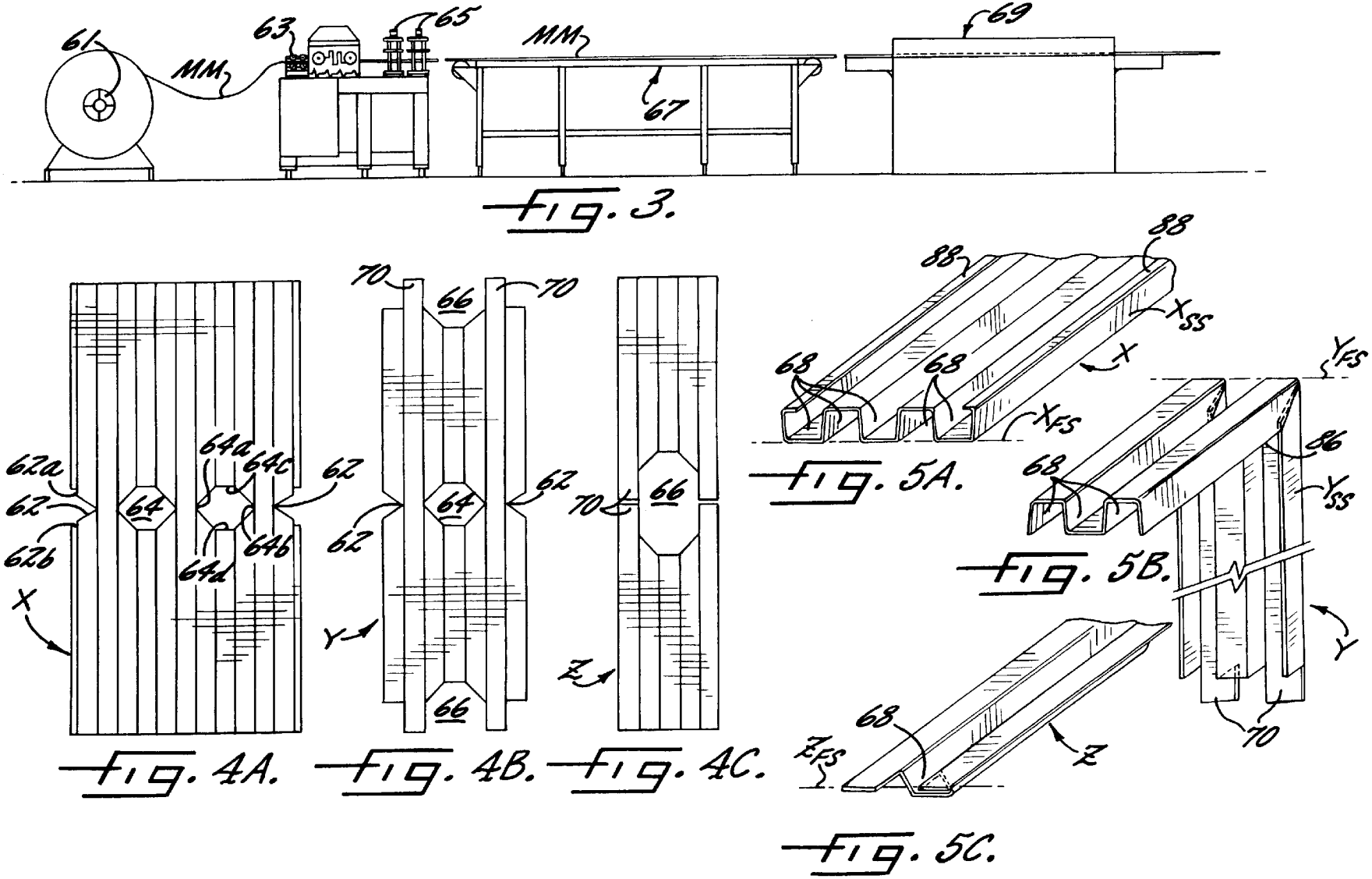
FIG. 3 is a schematic view of the process for manufacturing a strip of longitudinally corrugated metallic sheet material.
FIG. 4A is a top plan view of a first component of the longitudinally corrugated metallic sheet material.
FIG. 4B is a top plan view of a second component of the longitudinally corrugated metallic sheet material.
FIG. 4C is a top plan view of a third component of the longitudinally corrugated metallic sheet material.
FIG. 5A is a perspective view of the first component of the longitudinally corrugated metallic sheet material.
FIG. 5B is a perspective view of the second component of the longitudinally corrugated metallic sheet material.
FIG. 5C is a perspective view of the third component of the longitudinally corrugated metallic sheet material.

Component X as shown in FIG. 5A has five U-shaped ribs 68 while component Y shown in FIG. 5B has 3 U-shaped ribs 68, and component Z shown in FIG. 5C has 1 U-shaped rib 68. As may be seen by comparing FIGS. 5A–5C, component Z forms a center portion of component Y, which in turn forms a center portion of component X. This uniformity of design enables the same roll tooling to be used for all three components and minimizes the number of dies necessary to cut the notch 62 and cut-out patterns 64 and 66 therein. In addition, each of the longitudinally extending ribs 68 in the X, Y, and Z components has the same height and width creating a uniformly corrugated configuration in each of the components which provides great strength to the frame 52. Tests were conducted to analyze the stress and the displacement of each of the corrugated X, Y, and Z components under a load. The load was applied to each flat surface Xfs, Yfs and Zfs of the X, Y and Z components, respectively, and applied to side surface Xss of the X component and side surface Yss of the Y component (see FIGS. 5A–5C). The results of the tests are summarized in the following examples.

EXAMPLE 1

(i) An X component of 1010 CD Steel (yield strength $S_y$=44 kpsi) and an X component of 1008 CD Steel (yield strength $S_y$=41.5 kpsi), each having a thickness of 0.038 inches were tested under various loads applied to the flat surface Xfs. Nodes along the edge of the long end of the tested steel were restrained in all coordinate directions. The load was applied at the geometric center of the X component and distributed over a 12 inch wide area. The X component tested had a length of 72 inches.

| Net Load (lb) | Maximum Principal Stress (psi) | Maximum Displacement (inch) |
|---|---|---|
| 200 | 18829 | 0.381 |
| 250 | 23536 | 0.477 |
| 300 | 28244 | 0.572 |
| 350 | 32051 | 0.667 |
| 400 | 37658 | 0.762 |
| 450 | 42366 | 0.858 |

-continued

| Net Load (lb) | Maximum Principal Stress (psi) | Maximum Displacement (inch) |
|---|---|---|
| 500 | 47073 | 0.953 |
| 550 | 51780 | 1.048 |

The results of the test showed that the 1010 CD Steel had a maximum yield stress of 467 lbs. and a 0.890 inch displacement at load. The 1008 CD Steel had a maximum yield stress of 441 lbs. with a 0.840 inch displacement at load.

(ii) A Y component of 1010 CD Steel (yield strength $S_y$=44 kpsi) and a Y component of 1008 CD Steel (yield strength $S_y$=41.5 kpsi), each having a thickness of 0.038 inches were tested under various loads applied to the flat surface Yfs. Nodes along the edge of the long end of the tested steel were restrained in all coordinate directions. The load was applied at the geometric center of the Y component and distributed over a 12 inch wide area. The Y component tested had a length of 72 inches.

| Net Load (lb) | Maximum Principal Stress (psi) | Maximum Displacement (inch) |
|---|---|---|
| 100 | 19481 | 0.377 |
| 150 | 29222 | 0.566 |
| 200 | 38963 | 0.755 |
| 250 | 48703 | 0.944 |
| 300 | 58444 | 1.132 |
| 350 | 68185 | 1.321 |

The results of the test showed that the 1010 CD Steel had a maximum yield stress of 226 lbs. and a 0.852 inch displacement at load. The 1008 CD Steel had a maximum yield stress of 213 lbs. with a 0.803 inch displacement at load.

(iii) A Z component of 1010 CD Steel (yield strength $S_y$=44 kpsi) and a Z component of 1008 CD Steel (yield strength $S_y$=41.5 kpsi), each having a thickness of 0.038 inches were tested under various loads applied to the flat surface Zfs. Nodes along the edge of the long end of the tested steel were restrained in all coordinate directions. The load was applied at the geometric center of the Z component and distributed over a 6 inch wide area. The Z component tested had a length of 34 inches.

| Net Load (lb) | Maximum Principal Stress (psi) | Maximum Displacement (inch) |
|---|---|---|
| 200 | 24251 | 0.107 |
| 250 | 30313 | 0.133 |
| 300 | 36376 | 0.160 |
| 350 | 42438 | 0.187 |
| 400 | 48501 | 0.213 |
| 450 | 54566 | 0.240 |

The results of the test showed that the 1010 CD Steel had a maximum yield stress of 363 lbs. and a 0.194 inch displacement at load. The 1008 CD Steel had a maximum yield stress of 342 lbs. with a 0.183 inch displacement at load.

EXAMPLE 2

(i) An X component of 1010 CD Steel (yield strength $S_y$=44 kpsi) and an X component of 1008 CD Steel (yield strength $S_y$=41.5 kpsi), each having a thickness of 0.038 inches were tested under various loads applied to the side surface Xss. Nodes along the edge of the long end of the tested steel were restrained in all coordinate directions. The load was applied at the geometric center of the X component and distributed over a 12 inch wide area. The X component tested had a length of 72 inches.

| Net Load (lb) | Maximum Principal Stress (psi) | Maximum Displacement (inch) |
|---|---|---|
| 200 | 16671 | 0.065 |
| 250 | 20838 | 0.081 |
| 300 | 25006 | 0.097 |
| 350 | 29174 | 0.113 |
| 400 | 33341 | 0.129 |
| 450 | 37509 | 0.145 |
| 500 | 41677 | 0.161 |
| 550 | 45844 | 0.178 |

The results of the test showed that the 1010 CD Steel had a maximum yield stress of 528 lbs. and a 0.172 inch displacement at load. The 1008 CD Steel had a maximum yield stress of 498 lbs. with a 0.161 inch displacement at load.

(ii) A Y component of 1010 CD Steel (yield strength $S_y$=44 kpsi) and a Y component of 1008 CD Steel (yield strength $S_y$=41.5 kpsi), each having a thickness of 0.038 inches were tested under various loads applied to the side surface Yss. Nodes along the edge of the long end of the tested steel were restrained in all coordinate directions. The load was applied at the geometric center of the Y component and distributed over a 12 inch wide area. The Y component tested had a length of 72 inches.

| Net Load (lb) | Maximum Principal Stress (psi) | Maximum Displacement (inch) |
|---|---|---|
| 100 | 14513 | 0.059 |
| 150 | 21771 | 0.089 |
| 200 | 29028 | 0.119 |
| 250 | 36284 | 0.149 |
| 300 | 43541 | 0.178 |
| 350 | 50798 | 0.208 |
| 400 | 58055 | 0.238 |
| 450 | 65312 | 0.267 |

The results of the test showed that the 1010 CD Steel had a maximum yield stress of 303 lbs. and a 0.180 inch displacement at load. The 1008 CD Steel had a maximum yield stress of 286 lbs. with a 0.170 inch displacement at load.

EXAMPLE 3

(i) An X component of 1010 CD Steel (yield strength $S_y$=44 kpsi) and an X component of 1008 CD Steel (yield strength $S_y$=41.5 kpsi), each having a thickness of 0.030 inches were tested under various loads applied to the flat surface Xfs. Nodes along the edge of the long end of the tested steel were restrained in all coordinate directions. The load was applied at the geometric center of the X component and distributed over a 12 inch wide area. The X component tested had a length of 72 inches.

| Net Load (lb) | Maximum Principal Stress (psi) | Maximum Displacement (inch) |
|---|---|---|
| 200 | 24349 | 0.487 |
| 250 | 30437 | 0.609 |
| 300 | 36524 | 0.731 |
| 350 | 42611 | 0.852 |
| 400 | 48699 | 0.974 |
| 450 | 54786 | 1.096 |
| 500 | 60873 | 1.217 |
| 550 | 66960 | 1.339 |

The results of the test showed that the 1010 CD Steel had a maximum yield stress of 361 lbs. and a 0.879 inch displacement at load. The 1008 CD Steel had a maximum yield stress of 341 lbs. with a 0.830 inch displacement at load.

(ii) A Y component of 1010 CD Steel (yield strength $S_y$=44 kpsi) and a Y component of 1008 CD Steel (yield strength $S_y$=41.5 kpsi), each having a thickness of 0.030 inches were tested under various loads applied to the flat surface Yfs. Nodes along the edge of the long end of the tested steel were restrained in all coordinate directions. The load was applied at the geometric center of the Y component and distributed over a 12 inch wide area. The Y component tested had a length of 72 inches.

| Net Load (lb) | Maximum Principal Stress (psi) | Maximum Displacement (inch) |
|---|---|---|
| 100 | 25010 | 0.483 |
| 150 | 37516 | 0.725 |
| 200 | 50021 | 0.967 |
| 250 | 62526 | 1.209 |
| 300 | 75031 | 1.450 |

The results of the test showed that the 1010 CD Steel had a maximum yield stress of 176 lbs. and a 0.850 inch displacement at load. The 1008 CD Steel had a maximum yield stress of 166 lbs. with a 0.802 inch displacement at load.

(iii) A Z component of 1010 CD Steel (yield strength $S_y$=44 kpsi) and a Z component of 1008 CD Steel (yield strength $S_y$=41.5 kpsi), each having a thickness of 0.030 inches were tested under various loads applied to the flat surface Zfs. Nodes along the edge of the long end of the tested steel were restrained in all coordinate directions. The load was applied at the geometric center of the Z component and distributed over a 6 inch wide area. The Z component tested had a length of 34 inches.

| Net Load (lb) | Maximum Principal Stress (psi) | Maximum Displacement (inch) |
|---|---|---|
| 200 | 31272 | 0.144 |
| 250 | 39090 | 0.180 |
| 300 | 46908 | 0.216 |
| 350 | 54726 | 0.252 |
| 400 | 62544 | 0.288 |

The results of the test showed that the 1010 CD Steel had a maximum yield stress of 281 lbs. and a 0.202 inch displacement at load. The 1008 CD Steel had a maximum yield stress of 265 lbs. with a 0.191 inch displacement at load.

EXAMPLE 4

(i) An X component of 1010 CD Steel (yield strength $S_y$=44 kpsi) and an X component of 1008 CD Steel (yield strength $S_y$=41.5 kpsi) having a thickness of 0.030 inches were tested under various loads applied to the side surface Xss. Nodes along the edge of the long end of the tested steel were restrained in all coordinate directions. The load was applied at the geometric center of the X component and distributed over a 12 inch wide area. The X component tested had a length of 72 inches.

| Net Load (lb) | Maximum Principal Stress (psi) | Maximum Displacement (inch) |
|---|---|---|
| 200 | 25414 | 0.111 |
| 250 | 31767 | 0.138 |
| 300 | 38121 | 0.166 |
| 350 | 44474 | 0.194 |
| 400 | 50827 | 0.221 |
| 450 | 57181 | 0.249 |
| 500 | 63534 | 0.277 |

The results of the test showed that the 1010 CD Steel had a maximum yield stress of 346 lbs. and a 0.192 inch displacement at load. The 1008 CD Steel had a maximum yield stress of 327 lbs. with a 0.181 inch displacement at load.

(ii) A Y component of 1010 CD Steel (yield strength $S_y$=44 kpsi) and a Y component of 1008 CD Steel (yield strength $S_y$=41.5 kpsi) having a thickness of 0.030 inches were tested under various loads applied to the side surface Yss. Nodes along the edge of the long end of the tested steel were restrained in all coordinate directions. The load was applied at the geometric center of the Y component and distributed over a 12 inch wide area. The Y component tested had length of 72 inches.

| Net Load (lb) | Maximum Principal Stress (psi) | Maximum Displacement (inch) |
|---|---|---|
| 100 | 23013 | 0.086 |
| 150 | 34520 | 0.133 |
| 200 | 46026 | 0.177 |
| 250 | 57533 | 0.222 |
| 300 | 69039 | 0.266 |

The results of the test showed that the 1010 CD Steel had a maximum yield stress of 191 lbs. and a 0.169 inch displacement at load. The 1008 CD Steel had a maximum yield stress of 180 lbs. with a 0.160 inch displacement at load.

As may be seen by the tests conducted in the Examples above, the uniform shape of the ribs 68 provides significant strength to each of the X, Y, and Z components and to the resultant frame 52.

To simplify the explanation of the method used to construct the frame 52 and each of its subassemblies, each subassembly will be discussed separately in detail below.

The Two Arm Frame Portions

Referring to FIGS. 7–14 and 16, it may be seen that one of the two arm frame portions 58 is shown to illustrate how it is formed from the components previously discussed. It is to be understood that the second of the two arm frame portions 58 is identical to and the mirror image of the arm frame portion 68 described below. In the embodiment shown in FIG. 7, the arm frame portion 58 is formed from a single X component and three Y components, Y1–Y3, respectively. The bend cut-outs 64 and the notches 62, shown in FIG. 4A, combine to form bend locations which enable the X component to be folded into 90° corners by hand, without the use of any type of fixturing. The X component is bent at these two bend cut-outs 64 into the inverted U-shape shown, which form three peripheral edge members of the arm frame portion 58. In addition, the method used to form the notches 62 in the X and Y components results in the strip of metal NM bending slightly inward adjacent side 62*a* (see FIGS. 4A and 4B) of the notch and bending slightly outward adjacent side 62*b* (see FIGS. 4A and 4B) of the notch. This enables the opposed sides of the notch 62, which are cut at an angle of approximately 57°, to interlace or overlap with each other as the component is bent at the bend cut-outs 64, to provide torsional stability to component X. Each cut-out 64 shown in FIGS. 5A and 5B is shaped to include transversely spaced apart opposed V-shaped edges 64*a* and 64*b* and a medial portion with opposed sides 64*c* and 64*d*. Each of the V-shaped edges 64*a* and 64*b* are oriented so that each V-shaped edge has an 88° angle which points away from the other V-shaped edge and such that the sides 64*c* and 64*d* of the medial portion, which join the opposed V-shaped edges, are parallel.

Figure 7:
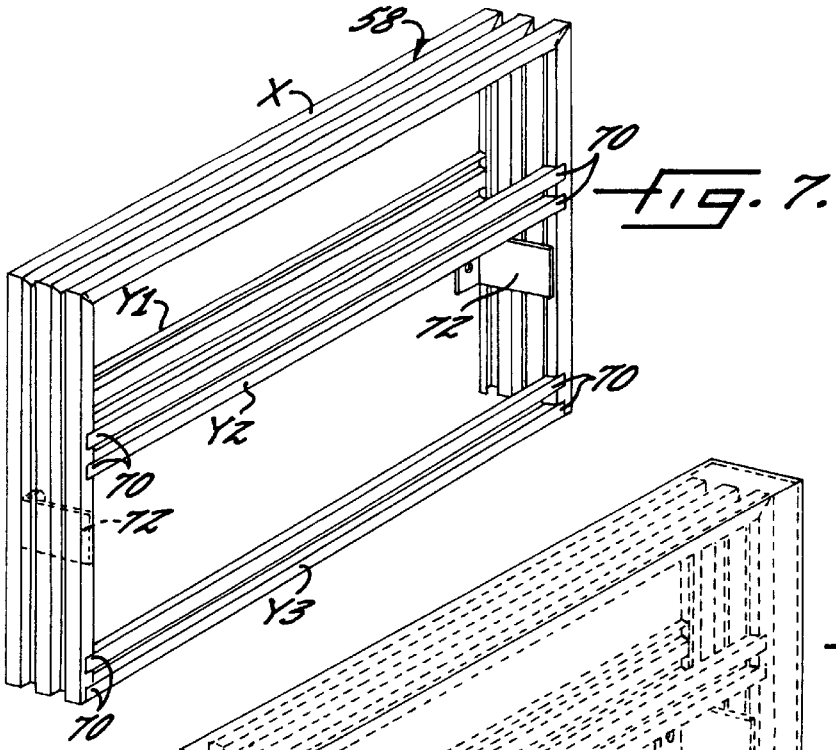
FIG. 7 is an enlarged perspective view of one of the two arm frame portions shown in FIG. 2.
Figure 8:
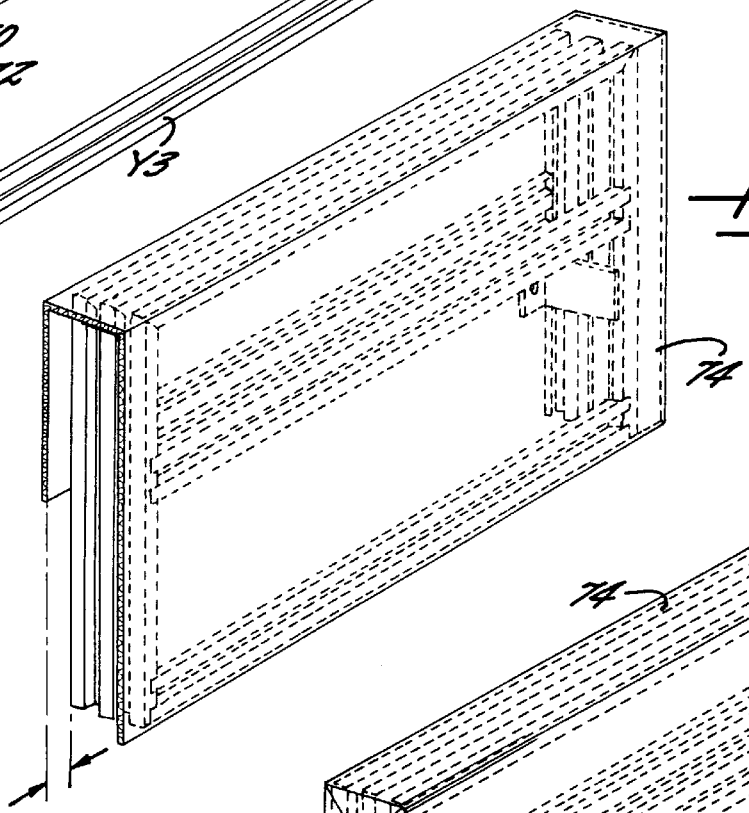
FIG. 8 is a perspective view of the two arm frame portion illustrated in FIG. 7 showing the attachment of a cardboard covering.

Two Y components, Y1 and Y2, are added opposite one another on each side of the X component to act as braces therefor. A third Y component, Y3, is added on the outside of the lower end of the X component as shown in FIG. 7 to provide additional support. In this embodiment, the Y components are each provided with tabs 70 which are used to weld each end of the Y components to the X component. Connecting plates 72 are fastened to the inside front and back of the X component, as shown in FIG. 7, so that the arm frame portion 58 may subsequently be attached to the base frame portion 54. Each connecting plate 72 extends the width of the component so that it will be flush with the base frame portion 54.

Figure 9:
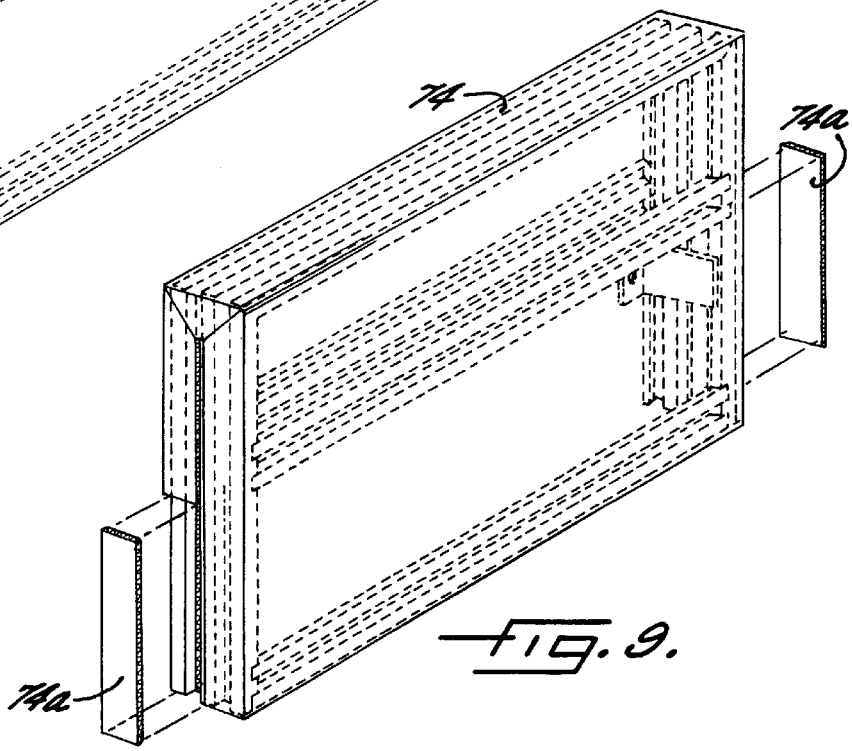
FIG. 9 is a perspective view of the two arm frame portion illustrated in FIG. 8 showing the folding of the edges of a cardboard covering and the attachment of additional cardboard.

FIGS. 8–16 illustrate the method of attaching upholstery FF to the arm frame portion 58. A pre-cut rectangular piece of vinyl coated cardboard 74 is folded and attached, by hot glue or the like, to the arm frame portion 58 to conform to the shape thereof and extend 2½" beyond the front and rear of the arm frame portion. It should be noted that the cardboard 74 is attached to the interior of the arm frame portion 58 beginning only about half way up. As shown in FIG. 9, sides of the cardboard 74 are folded around the ends of the arm frame portion 58 to lie flush therewith. An additional piece of cardboard 74*a* is attached to the front and back of the arm frame portion 58 as shown.

Figures 10, 11, 12:
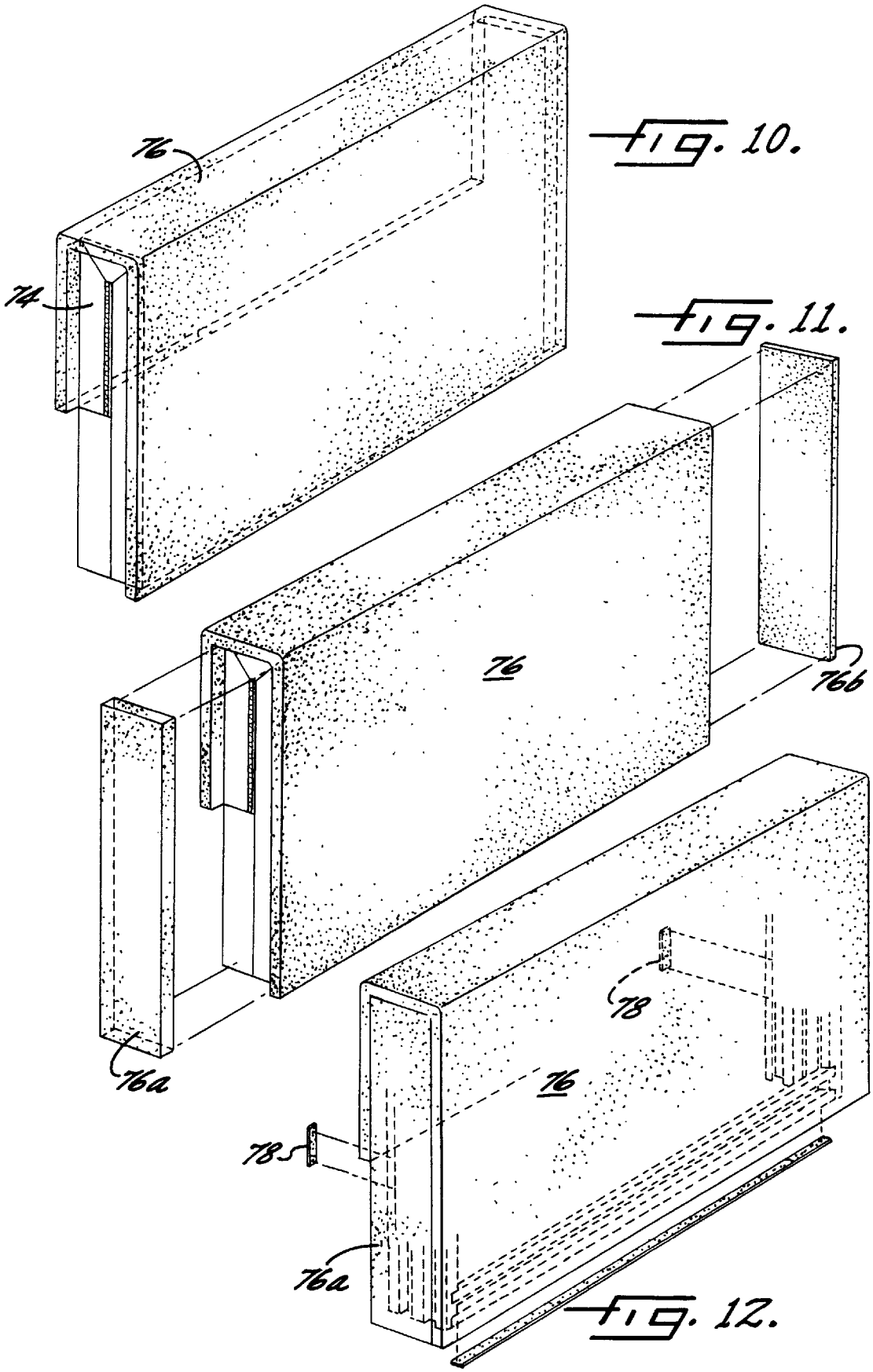
FIG. 10 is a perspective view of the two arm frame portion illustrated in FIG. 9 showing the attachment of padding.
FIG. 11 is a perspective view of the two arm frame portion illustrated in FIG. 10 showing the attachment of end portions of the padding.
FIG. 12 is a perspective view of the two arm frame portion illustrated in FIG. 11 showing the attachment of strips of one of either hook portions or loop portions to the two arm frame portion.

A polyfoam padding 76, shown in FIGS. 10 and 11, is applied over the cardboard 74. The padding 76 is about 1" thick and extends 1" beyond the front and ½" beyond the back of the arm frame portion 58. The padding 76 is not bent or folded around the front and back of the arm frame portion 58 as was the cardboard 74. A 1" padding panel 76*a* is attached to the front and a ½" padding panel 76*b* is attached to the back of the arm frame portion 58, as shown in FIGS. 10 and 11.

Figures 13, 14:
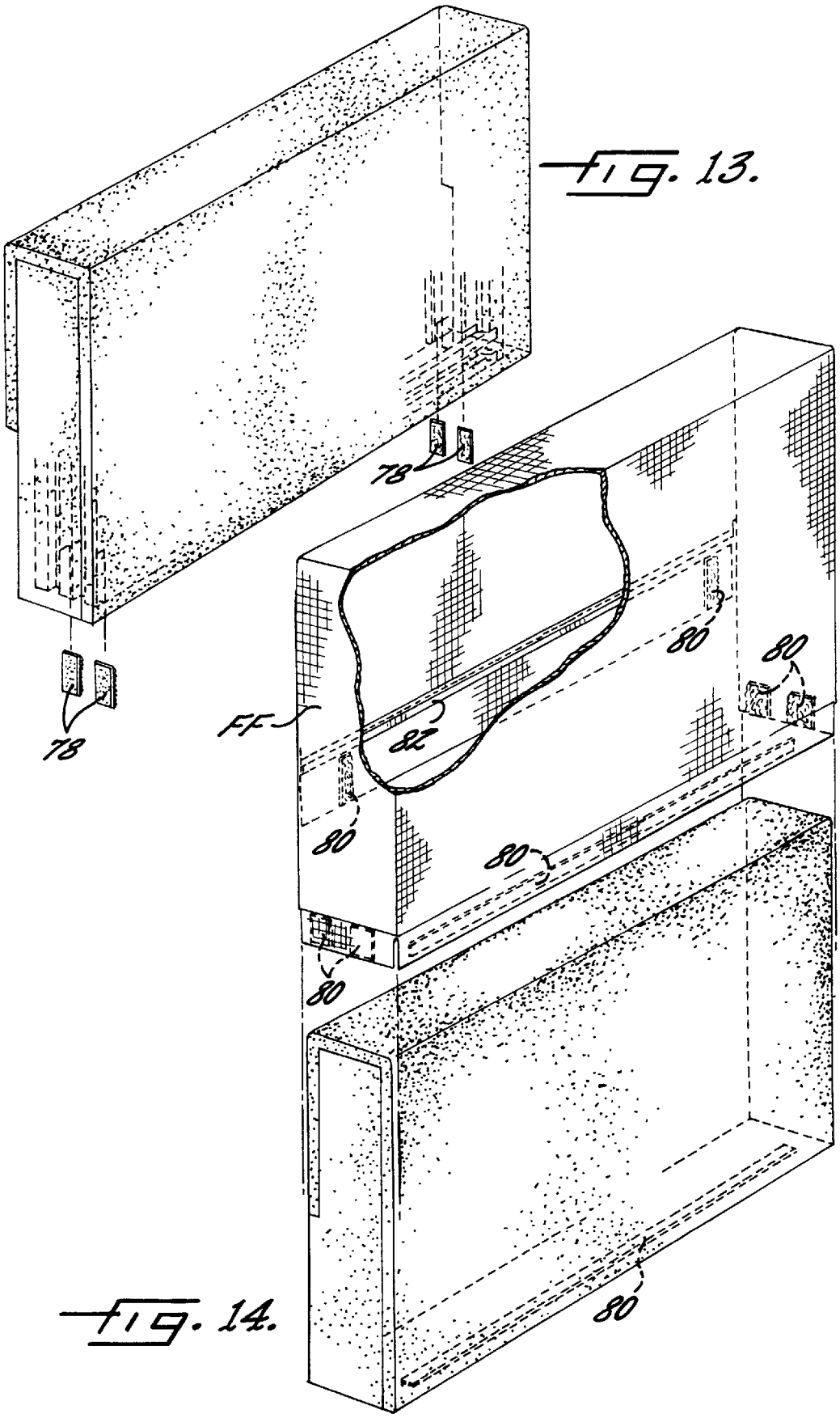
FIG. 13 is a perspective view of the two arm frame portion illustrated in FIG. 12 showing the attachment of strips of the other of the hook portions or the loop portions to the upholstery.
FIG. 14 is a perspective view of the two arm frame portion illustrated in FIG. 13 showing the placement of the upholstery thereon.
Figure 15A:
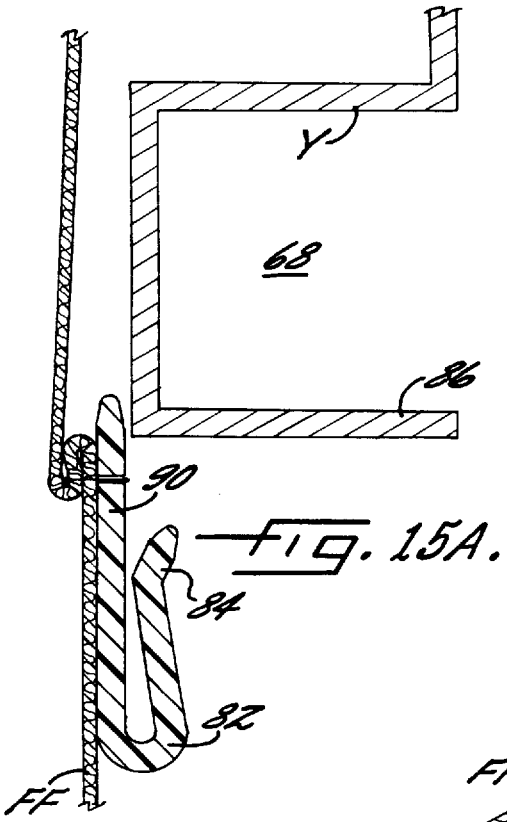
FIG. 15A is an end view of a J-strip having a first end adapted to be attached to an end of the strip of longitudinal metallic sheet of material and having a second end connected to the upholstery.
Figure 15B:
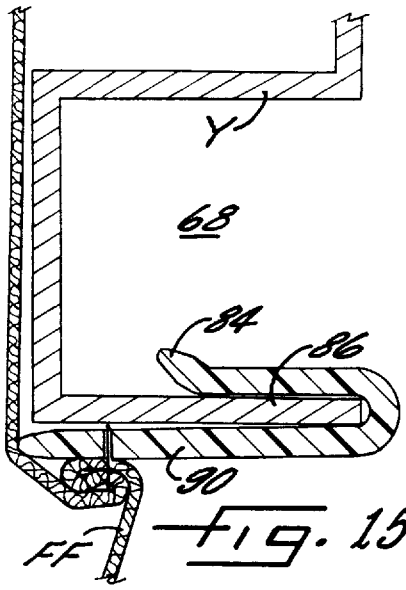
FIG. 15B is an end view of the J-strip shown in FIG. 15A attached to the strip of longitudinal metallic sheet of material.
Figure 16:
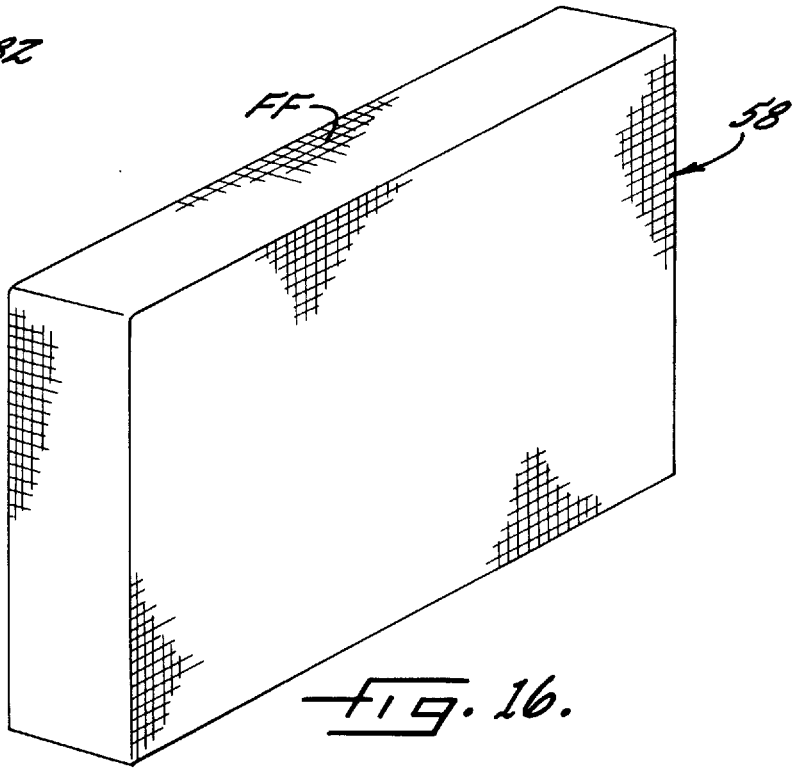
FIG. 16 is a perspective view of a completed arm of the article of furniture shown in FIG. 1.

As illustrated in FIGS. 12–14, a number of strips of Velcro® hooks 78 are attached to the arm frame portion 58 in specific positions as shown, to cooperate with a corresponding number of Velcro® loops 80 attached to the upholstery FF to removably attach the upholstery FF to the arm frame portion 58. In FIG. 14, it is seen that the upholstery FF, which has been sewn in "boot-cover" fashion to fit the arm frame portion 58, is slipped over the arm frame portion and removably attached by corresponding strips of Velcro® hooks 78 and loops 80 and by at least one J-strip 82. The use of Velcro® in combination with the J-strip allows the upholstery FF to be tightened and secured to ensure a smooth covering. As best shown in FIGS. 14, 15A and 15B, the plastic J-strip 82 has a first end 84 which is angled away from the remainder of the J-strip. The first end 84 is shaped to fit over a free end 86 of the Y component or an inwardly facing flange 88 on the X component (shown in FIG. 5A). A second end 90 of the J-strip 82 is attached to the upholstery FF which is to be removably attached to the arm frame portion 58. A completed arm frame portion 58 is shown in FIG. 16.

The Base Frame Portion

Figure 17:
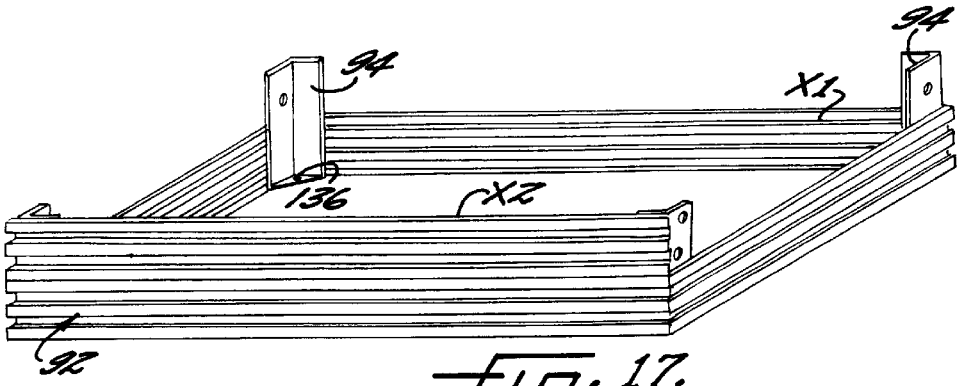
FIG. 17 is an enlarged perspective view of the base frame portion shown in FIG. 2.
Figure 18:
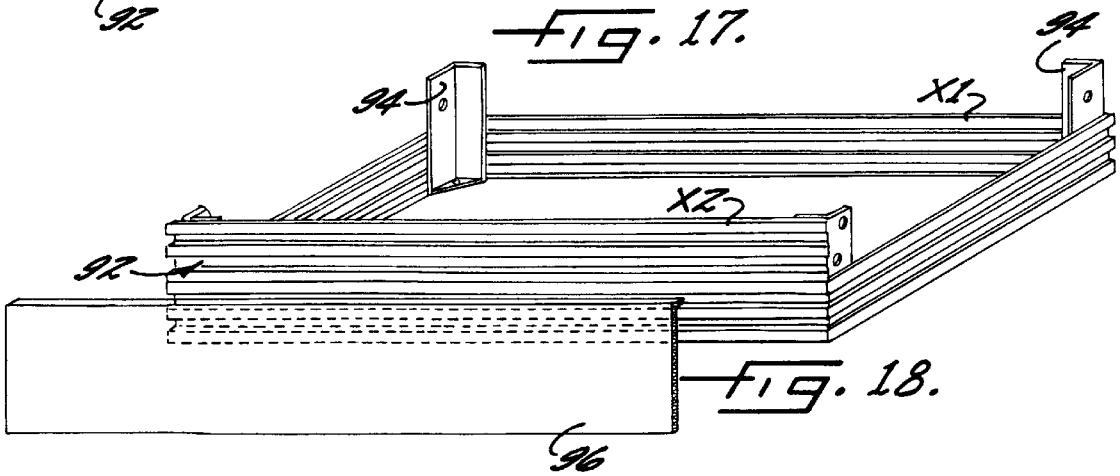
FIG. 18 is a perspective view of the base frame portion illustrated in FIG. 17 showing the attachment of a cardboard covering.
Figure 19:
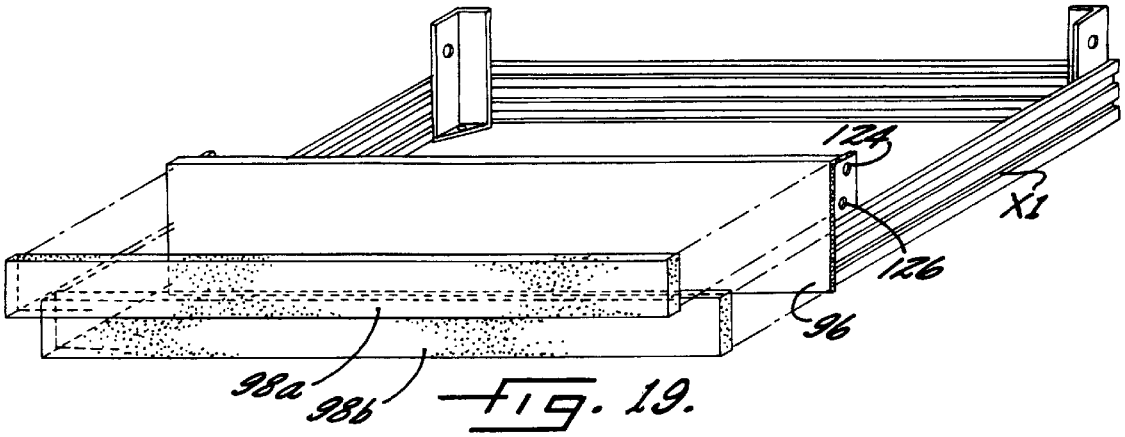
FIG. 19 is a perspective view of the base frame portion illustrated in FIG. 18 showing the attachment of padding.
Figure 20:
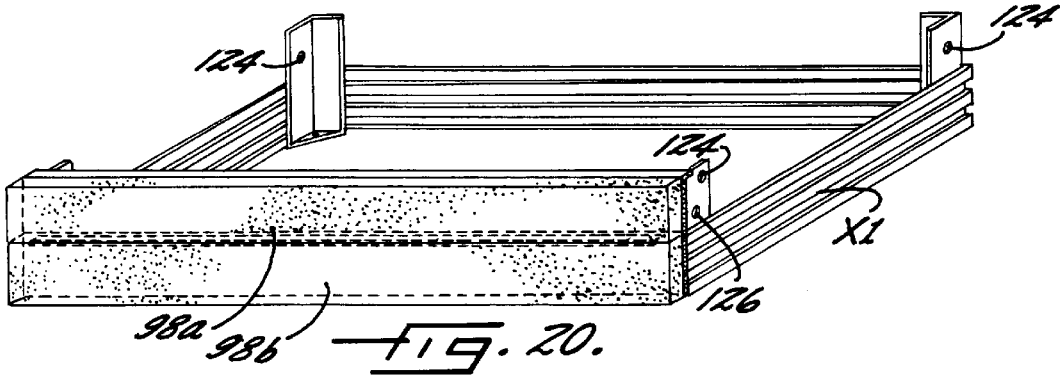
FIG. 20 is a perspective view of the base frame portion illustrated in FIG. 19 showing the attachment of strips of one of either the Velcro® hook portions or loop portions.

In the embodiment shown in FIG. 17, the base frame portion 34 is formed from two components, X1 and X2. One of the components, X1 is bent at the bend cutouts 64 into a generally rectangular shape having opposed side edges and opposite ends, which form four peripheral edge members of the base frame portion 54. The bend cut-outs 64 and the notches 62 combine to form bend locations which enable the X1 component to be folded into 90° corners. Adjacent leading and trailing ends of the X1 component are welded or otherwise fastened together to form a unitary component. The X2 component is welded or otherwise attached to the X1 component such that sides of the X1 and X2 components are in abutting relationship, as shown in FIGS. 17 and 18, to form a front panel 92. The X2 component only extends along one of the opposed side edges of the X1 component. An attachment bracket 94 is welded to each corner of the X1 component. The X2 component is also welded to the attachment brackets 94 adjacent each end thereof. Because the base frame portion 54 is the major load bearing portion of the frame 52, it includes the inwardly facing flanges 88 which provide additional strength to the frame (see Examples 2(i) and 4(i)).

FIGS. 18–22 illustrate the method of attaching upholstery FF to the base frame portion 54. Unlike the arm frame portion 58, the base frame portion 54 only requires the front panel 92 to be upholstered. As shown in FIG. 18, a pre-cut vinyl-coated cardboard 96 is applied to the front panel 92. The cardboard 96 is bent to cover the top flange 88 of the X2 component, while the bottom flange 88 of the X1 component is left uncovered.

Figure 21:
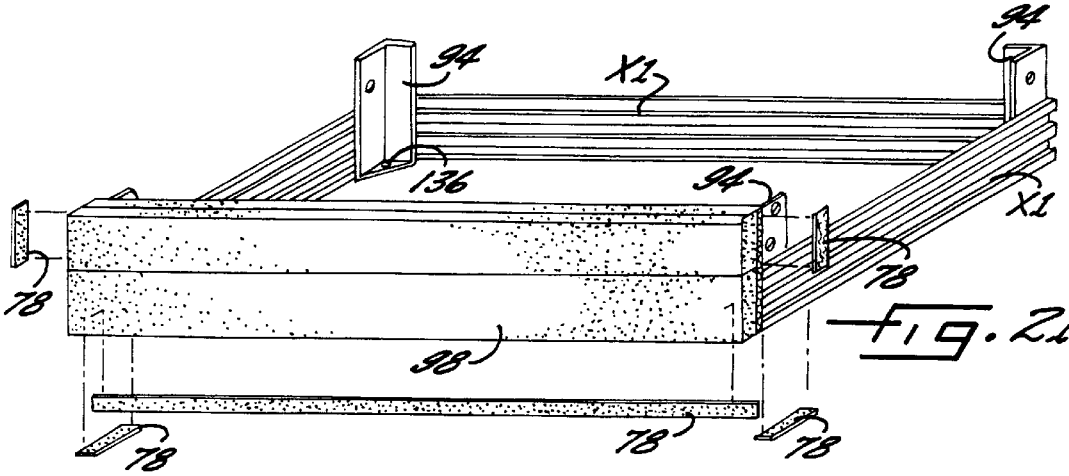
FIG. 21 is a perspective view of the base frame portion illustrated in FIG. 20 showing the attachment of strips of one of either the Velcro® hook portions or loop portions to the base frame portion.
Figure 22:
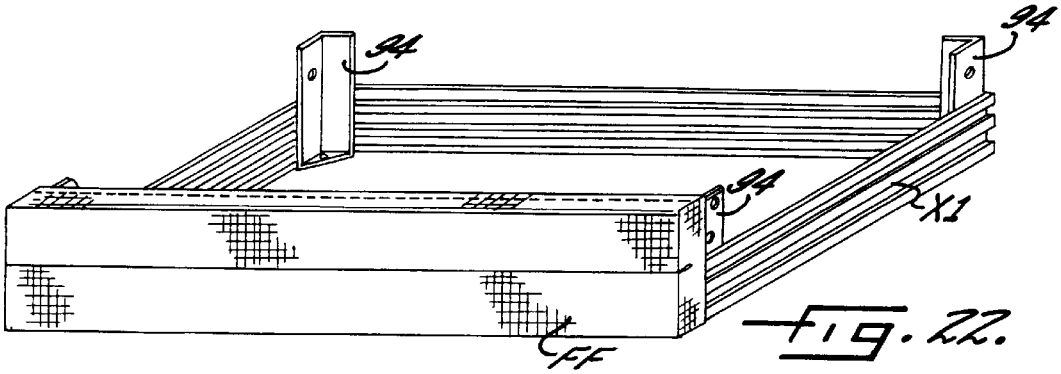
FIG. 22 is a perspective view of a completed base of the article of furniture shown in FIG. 1.

Polyfoam padding 98 similar to that used with the arm frame portion 58 is attached to the cardboard 96 in two pieces 98*a* and 98*b*. A strip of Velcro® hooks 78 are glued between the padding 98*a* and 98*b* to provide a fastening location for the upholstery FF, so that it can be tucked in, to present an appealing cosmetic appearance. As shown in FIG. 14, a strip of Velcro® hooks 78 are also attached along the bottom of the X1 component and on the sides of the attachment brackets 94, as shown in FIG. 21. The upholstery FF is removably attached to the front panel 92 of the base frame portion 54 by means of corresponding strips of Velcro® loops 80 and a J-strip 82 sewn onto the upholstery FF.

As shown in FIGS. 2 and 6, the base frame portion 54 includes the seat portion 60. The seat portion 60 is made up of a box spring 100 and at least two elongated strips of metallic sheet material which are formed, by the previously described methods, into a fourth component W. Each of the fourth components W is of sufficient length to span the base either lengthwise or widthwise. In this embodiment, the fourth components W each span the length of the base frame portion 54. A mating notch 102 is formed in each end of each fourth component W to seat or mate with the top flange 88 of the X1 component. Each end of the fourth component W has a screw opening 103 to receive a self drilling screw 105 which secures each end of each fourth component to the side edge of the X1 component. The upper surface of each of the fourth components W is substantially flat so that once the fourth components have been secured to the X1 component, the box spring 100 can be placed thereon and retained within the rectangular configuration of the X1 component by a series of fastening hooks 107. Each fastening hook 107 has a generally C-shaped configuration. As illustrated in FIG. 6, one end of the fastening hook 107 is configured to hook over the side of the fourth component W while the opposite end having a similar configuration, hooks over the box spring 100. The fastening hook 107 is flexible to allow for easy fastening of the box spring 100 to the fourth component W.

The Back Frame Portion

Figure 23:
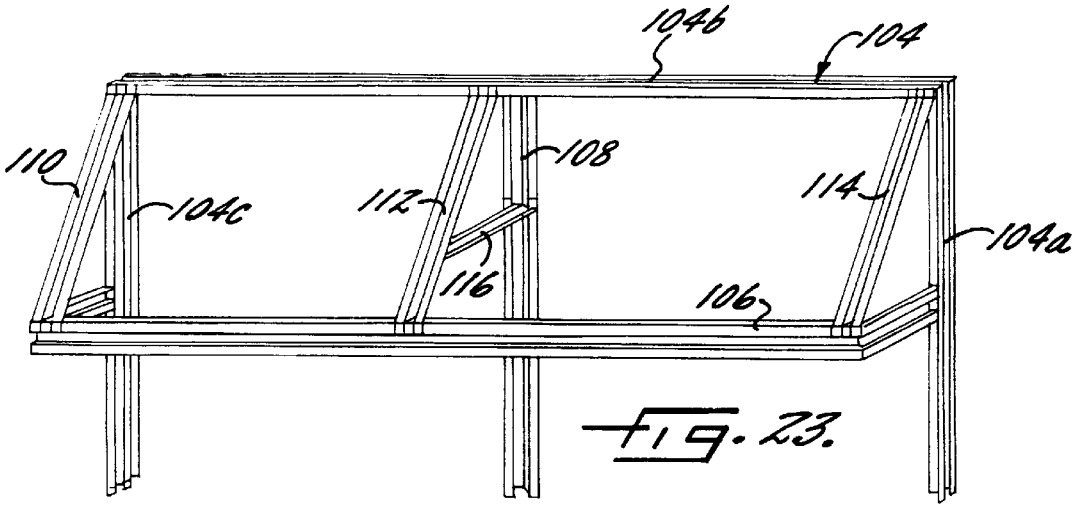
FIG. 23 is an enlarged perspective view of the back frame portion shown in FIG. 2.
Figure 24:
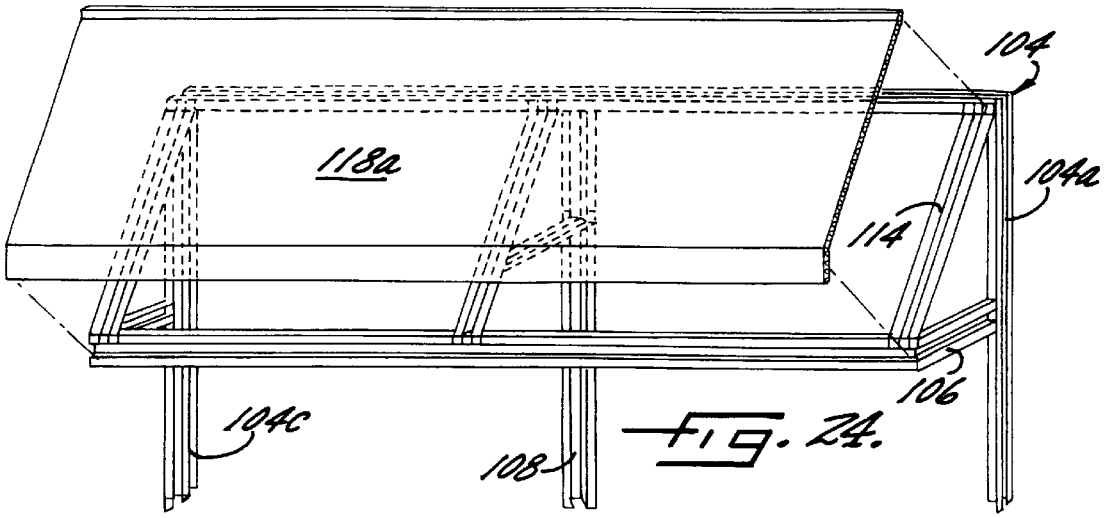
FIGS. 24–27 are a perspective view of the back frame portion illustrated in FIG. 23 showing the preferred steps in the attachment of a cardboard covering.
Figure 25:
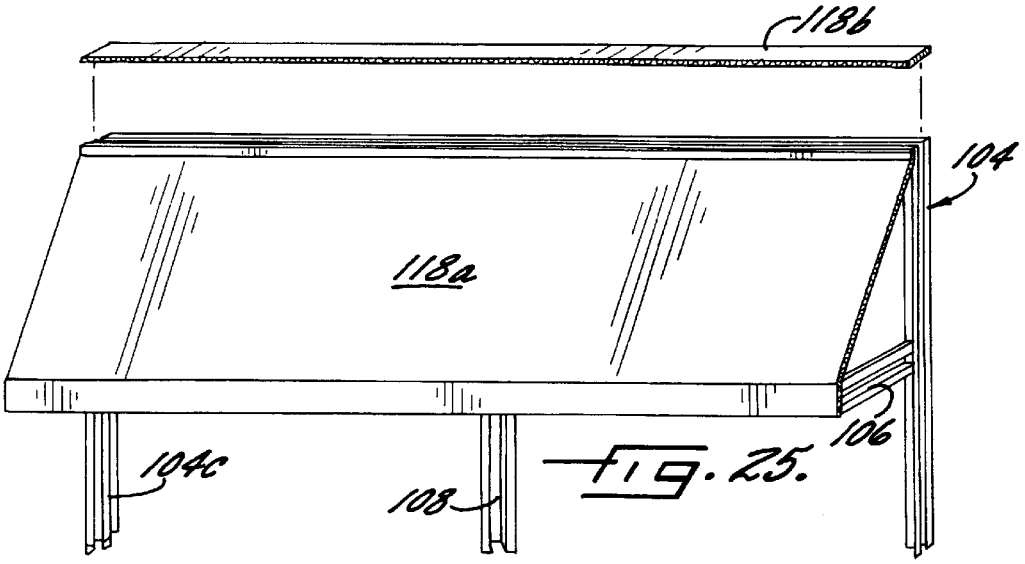
Figure 26:
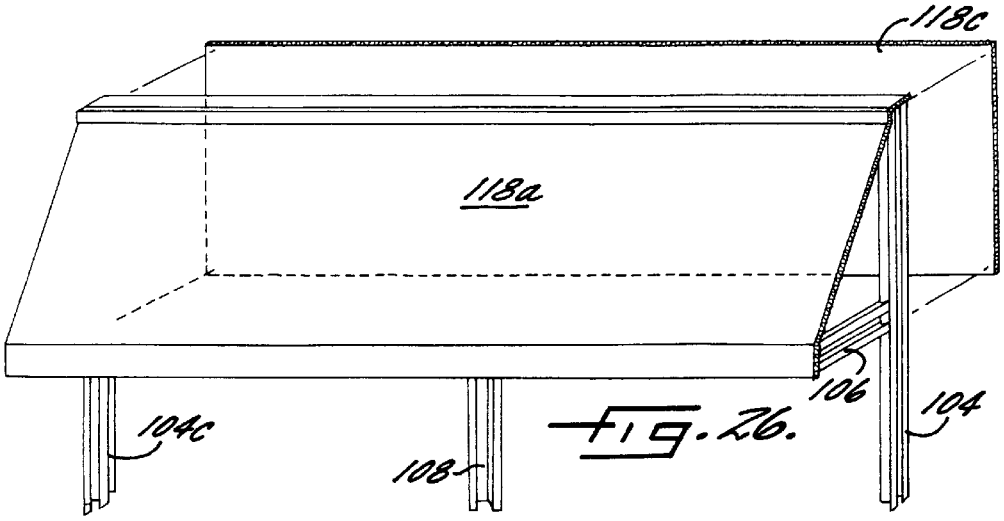
Figure 27:
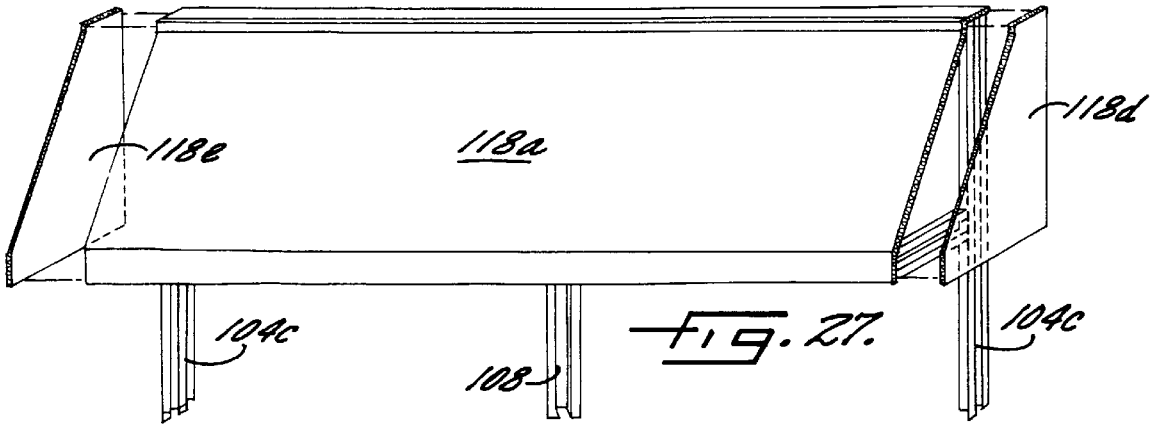

As illustrated in FIG. 23, the back frame portion 56 is formed from at least two Y components which are each bent at the cut-outs 64, to form a first member 104 and a second member 106. Each of the members 104 and 106 is U-shaped. If the first member 104 and the second member 106 were placed in the same orientation as the first member shown in FIG. 23, it may be seen that the second member 106 has a similar horizontal length, but a relatively shorter vertical length than the first member 104. The first member 104 is oriented so as to have an inverted U-shaped configuration and form three peripheral edge members 104*a*, 104*b* and 104*c*. As shown in FIG. 4B, the second member 106 is attached or is welded to edge members 104*a* and 104*b* of the first member 104, by tabs 70 extending from each end of the second member, in a generally transverse orientation thereto.

In this embodiment, a third Z component, third member 108, is welded or otherwise attached to the edge member 104*b*, in a generally central location between edge members 104*a* and 104*c*. The third member 108 is used to provide additional strength to the first member 104. It is to be understood that if the upholstered furniture which was being produced was a chair, the need for a third member 108 would not exist and if a longer span was required for a couch or a sofa bed it is possible to provide additional third members 108.

Three Z components 110, 112 and 114, respectively are provided to be welded, by tabs 70, between the edge member 104*a* and the second member 106 to brace or provide additional strength thereto. Another Z component 116 which is relatively shorter than the other, previously described, Z components is attached between the third member 108 and the second Z component 112 to provide a brace therebetween for additional strength. Other Z components 116 may be used if a longer span exists than in the present love seat 50 to provide the desired strength.

As shown in FIGS. 24–27, five sections of cardboard 118 are required to cover the back frame portion 56. First piece of cardboard 118*a* is applied to edge member 104*b*, first Z component 110, and second member 106 to cover the full width of the back frame portion 56. The first piece of cardboard 118*a* is folded to make such attachment to the second member 106 possible. A second piece of cardboard 118*b*, preferably having a 3" width is attached to the top of the edge member 104*b*. Next, a third cardboard 118*c* is attached to the back of the back frame portion 56 defined by the three edge members 104*a*–104*c*. Finally, a fourth piece of cardboard 118*d* and a fifth piece of cardboard 118*e* are attached to the opposed triangular areas on the sides of the back frame portion 56, formed by edge member 104*a*, second member 106 and third Z component 114, and edge member 104*c*, second member 106 and first Z component 110, respectively.

Figure 28:
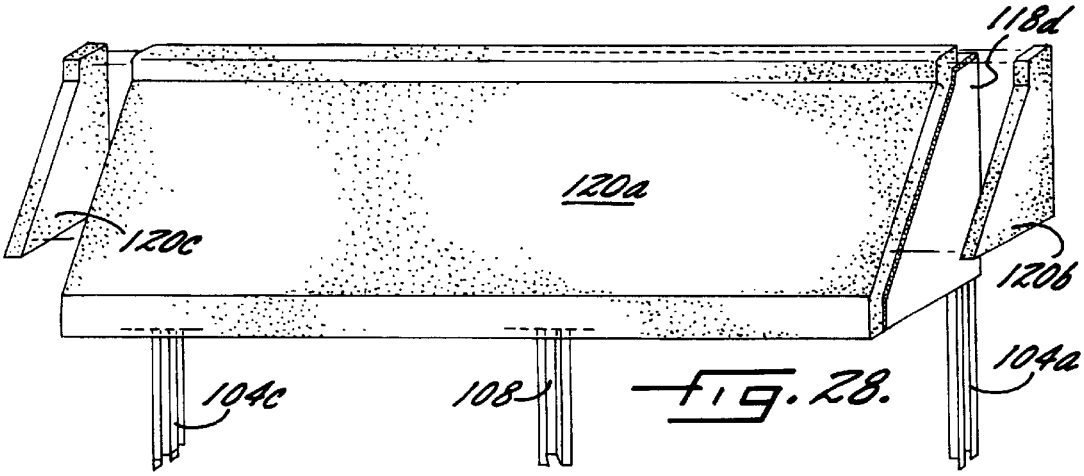
FIGS. 28 and 29 are a perspective view of the back frame portion illustrated in FIG. 27 showing the attachment of padding and the attachment of strips of one of either the Velcro® hook portions or loop portions to the back frame portion.
Figure 29:
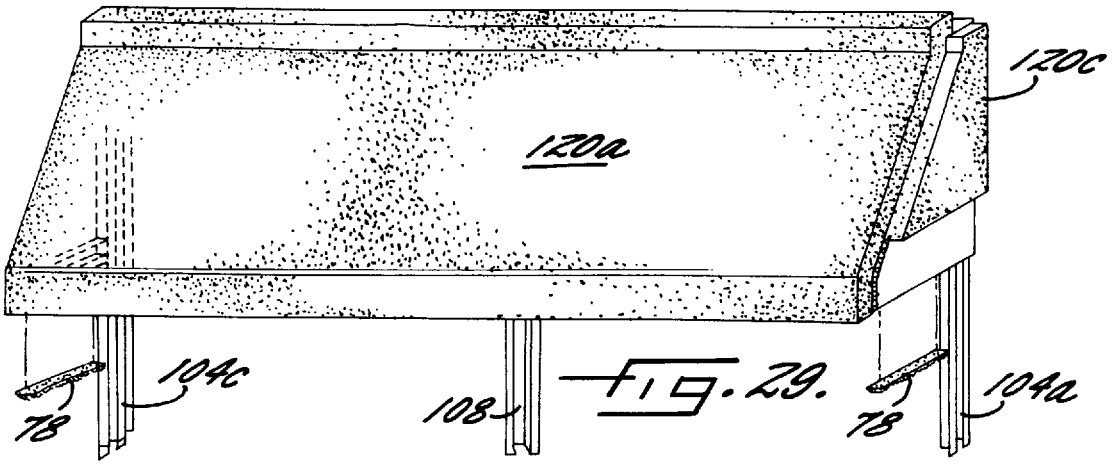
Figure 30:
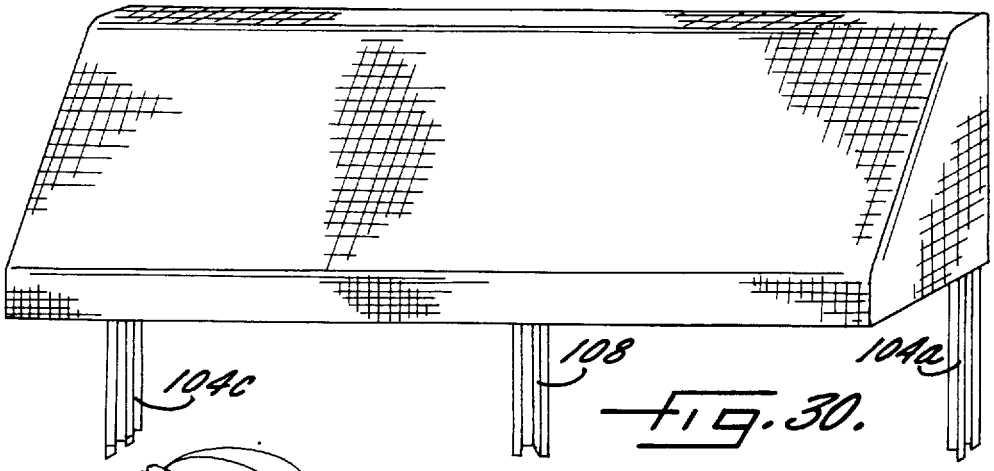
FIG. 30 is a perspective view of a completed back frame portion shown in FIG. 1.
Figure 31:
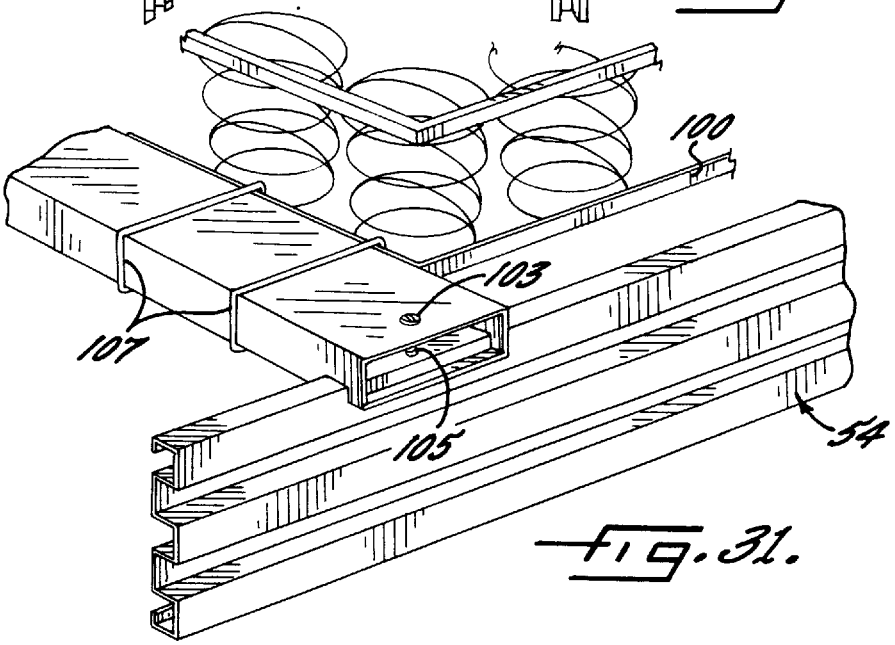
FIG. 31 is a perspective view of an enlarged section of the seating portion.

FIGS. 28 and 29 illustrate the attachment of padding pieces 120*a*, 120*b* and 120*c* to cover cardboard pieces 118*a*, 118*d* and 118*e*, respectively. The padding pieces are attached by hot glue. As shown, padding pieces 120*b* and 120*c* only extend approximately two-thirds of the distance of the corresponding cardboard pieces 118*d* and 118*e*. Strips of Velcro® hooks 78 are attached to the bottom of second member 106, as shown in FIG. 29. Strips of Velcro® loops 80 and J-strips 82 are sewn into the upholstery FF to enable the upholstery to be removably secured to the back frame portion 56.

The Frame

Once the upholstery has been attached to each of the base frame portion 54, the back frame portion 56 and the two arm frame portions 58, then the frame 52 is formed by interconnecting these subassemblies and the seating portion 60. With reference to FIGS. 2 and 6, it may be seen that each of the connecting plates 72 defines a plate aperture 122 which corresponds to a first bracket aperture 124 defined in each of the attachment brackets 94 (see FIG. 20). A second bracket aperture 126 is defined in each of the attachment brackets 94 which are adjacent the front panel 92. A fastener such as a bolt 128 is fitted into the each of the plate apertures 122 and the bracket apertures 124 to connect the two arm frame portions 58 and the lower portion of the back frame portion 56, to the base frame portion 54. An additional set of corresponding apertures 130*a* and 130*b* are formed in each of the back frame portion 56 and the two arm frame portions 58, respectively, through which another bolt 132 passes to secure the two arm frame portions 58 to the back frame portion 56. Legs 134 are threaded or inserted into tapped holes 136 defined in the attachment bracket 94, to support the frame 52. If desired, casters may be substituted for the legs 134. The fourth components W are then placed into mating relationship with the X1 component and the box spring 100 is placed thereon. Cushions GG and HH are placed on the back frame portion 56 and the box spring 100, respectively to complete the piece of upholstered furniture, in this case love seat 50.

It is possible to construct each of the subassemblies without the upholstery FF attached thereto. One reason for constructing the subassemblies without completing the frame 52 is for purposes of shipping. The construction of the base frame portion 54 allows the stacking of the two arm frame portions 58, the seating portion 60 and the back frame portion 56 into a relatively compact area which may then be palletized or placed within a container for shipping. Another reason for shipping the frame 52 in subassembly form is to allow the retailer or wholesaler to minimize its inventory and associated costs. Because of the interchangeable nature of the subassemblies, it is possible to inventory a number of the two arm frame portions 58 and inventory a smaller number of the base frame portions 54 and the back frame portions 56, in a variety of sizes, so that the two arm frame portions can be combined with different base frame portions and back frame portions to create a chair, a love seat, a couch or a sofa bed as needed. Because only bolts 128 and 132 are required to complete the assembly of the frame 52 and because of the ability to quickly attach the desired upholstery, it is easy for a retailer to inventory the frame in subassembly form and inventory a variety of upholstery choices. The retailer need only complete construction of the furniture once the sale has been made. This not only reduces associated shipping and storage costs, but also reduces the risk of unwanted inventory, either through the wrong mix of furniture and/or the wrong choice of available upholstery. This approach to furniture construction allows the consumer to more readily obtain a customized piece of furniture while allowing the retailer to reduce his size and cost of inventory. In addition, it is possible for the consumer, either as a result of damage to the upholstery FF or a desire for a different upholstery, to simply and easily remove the existing upholstery and replace it with a new or replacement upholstery in accordance with the method described above.

Many modifications of other embodiments of the invention will come to mind of one skilled in the art having the benefit of the teachings presented in the foregoing descriptions and the associated drawings. Therefore, it is to be understood that the invention is not limited to the specific embodiments disclosed, and that modifications and embodiments are intended to be included within the scope of the appended claims.

What is claimed is:

1. A method of fabricating an article of furniture comprising the steps of:

constructing a base frame portion, a back frame portion, and two arm frame portions, with said base frame portion comprising four peripheral edge members disposed in a rectangular arrangement so as to define opposite side edges and opposite ends, said back frame portion and said two arm frame portions each comprising at least three peripheral edge members which are interconnected to each other at right angles, and with each of said peripheral edge members of said base frame portion, said back frame portion and said two arm frame portions comprising at least one strip of longitudinally corrugated metallic sheet material;

at least substantially covering each of said base frame portion, said back frame portion, and said two arm frame portions with an upholstery material; and interconnecting said base frame portion, said back frame portion, and said two arm frame portions to each other so that all visible portions of said base frame portion, said back frame portion, and said two arm frame portions are covered by said upholstery material.

2. A method according to claim 1 wherein said covering step comprises attaching a J-strip having fabric upholstery connected thereto onto at least one of said base frame portion, said back frame portion and said two arm frame portions, and attaching a plurality of strips of hook portions and loop portions, wherein one of said hook portions and loop portions is selectively attached to at least one of said base frame portion, said back frame portion and said two arm frame portions, and the other of said hook portions and said loop portions is correspondingly attached to the upholstery to removingly secure the upholstery thereto.

3. A method according to claim 2 wherein said attaching of said J-strip comprises the step of directing a self-aligning lip of said J-strip onto said base frame portion.

4. A method of fabricating a frame member which is adapted to be used in constructing a frame for an article of furniture, and comprising the steps of:

providing an elongate strip of metallic sheet material; and forming a plurality of right angled corners in said sheet material, each of said right angled corners being formed by forming a V-shaped notch in each side of said strip so as define a transverse line therebetween;

forming at least one opening in said strip on said transverse line;

forming longitudinal corrugations along the length of said strip so as to define at least one U-shaped rib and parallel depending side edge wall segments when viewed in transverse cross section, with said one rib being interrupted by said one opening, and with said V-shaped notches being positioned in respective ones of said side wall segments; and folding the strip along said transverse line to form a right angled corner.

5. A method according to claim 4 wherein said V-shaped notches each define an included angle of less than 90 degrees so as to form overlapping portions along each side of said strip upon completion of said folding step.

6. A method according to claim 4 wherein said one opening is shaped to include transversely spaced apart opposite end portions and a medial portion, with said end portions each comprising a V-shaped edge which is oriented so that the V-shaped edge of one end portion points away from the V-shaped edge of the other end portion, and said medial portion comprises parallel edges.

7. A method according to claim 6 wherein said one U-shaped rib includes parallel depending wall segments and a base wall segment, and wherein said one opening is located such that the opposite end portions are positioned on respective ones of said depending wall segments of said one rib and said medial portion is positioned on said base wall segment of said one rib.

* * * * *